US009248893B2

(12) United States Patent
Hellweg et al.

(10) Patent No.: US 9,248,893 B2
(45) Date of Patent: Feb. 2, 2016

(54) PERSONAL PROTECTION SYSTEM INCLUDING A GARMENT WITH BODY ARMOUR AND A PERSONAL FLOTATION DEVICE

(71) Applicant: THF Innovation Pty Ltd, Bayswater (AU)

(72) Inventors: Albert Hellweg, Mitcham (AU); Cale Euan Pearce, Bayswater (AU)

(73) Assignee: THF INNOVATION PTY LTD, Bayswater, Victoria (AU)

( * ) Notice: Subject to any disclaimer, the term of this patent is extended or adjusted under 35 U.S.C. 154(b) by 63 days.

(21) Appl. No.: 14/053,961

(22) Filed: Oct. 15, 2013

(65) Prior Publication Data

US 2014/0216240 A1 Aug. 7, 2014

(30) Foreign Application Priority Data

Nov. 1, 2012 (AU) ..... 2012904819
Apr. 11, 2013 (AU) ..... 2013203831

(51) Int. Cl.
*F41H 1/02* (2006.01)
*B63C 9/125* (2006.01)
*B63C 9/00* (2006.01)

(52) U.S. Cl.
CPC ..... *B63C 9/1255* (2013.01); *F41H 1/02* (2013.01); *B63C 2009/0023* (2013.01)

(58) Field of Classification Search
USPC ..... 89/36.05, 36.02, 36.06, 36.07; 2/2.5, 2/462, 463; 441/106, 88, 80, 118, 92, 441/114, 115, 116, 117, 123
See application file for complete search history.

(56) References Cited

U.S. PATENT DOCUMENTS 3,345,657 A * 10/1967 Peeler et al. ..... 441/92
3,475,774 A 11/1969 Hawkins
3,672,609 A * 6/1972 Hawkins ..... 244/122 AE
5,584,737 A * 12/1996 Luhtala ..... 441/107

(Continued)

FOREIGN PATENT DOCUMENTS

EP 1021332 7/2000
EP 1587382 10/2005

(Continued)

*Primary Examiner* — Benjamin P Lee
(74) *Attorney, Agent, or Firm* — Frost Brown Todd LLC

(57) ABSTRACT

A garment comprises a panel adapted to comprise or retain body armor that protects a front region of the torso when the garment is worn and respective laterally spaced side pockets that extend generally vertically at the front side regions of the torso when the garment is worn. These side pockets have openings at their upper ends to removably receive the respective arms of a generally U-shaped, deflated but inflatable personal flotation device (PFD), that thereby extends behind the neck and/or head of the wearer. These side pockets have outer side fastenings that are separable by the inflating PFD arms to thereby allow the arms to fully expand. An inflatable personal flotation device (PFD), comprises a casing defining a central portion and a pair of laterally spaced, generally aligned arms extending therefrom whereby to define a generally U shaped configuration, and bladder means within the central portion and the laterally spaced arms, able to receive and retain compressed gas for inflating the bladder means and the personal flotation device. At least the central portion of the casing is at least partially inlaid or overlaid by armor to protect the bladder means from puncture by impinging projectiles. Also disclosed is a personal protection system comprising the garment and the PFD.

20 Claims, 14 Drawing Sheets

(56) References Cited

U.S. PATENT DOCUMENTS

| | | | | |
|---|---|---|---|---|
| 6,062,929 | A * | 5/2000 | Hallstrom | 441/106 |
| 6,659,689 | B1 | 12/2003 | Courtney et al. | |
| 6,681,399 | B1 * | 1/2004 | Kerr | 2/2.5 |
| 6,805,519 | B1 | 10/2004 | Courtney | |
| 6,824,106 | B2 * | 11/2004 | Douglas et al. | 244/151 R |
| 7,080,411 | B2 | 7/2006 | Kerr | |
| 7,182,662 | B2 | 2/2007 | O'Meara et al. | |
| RE42,238 | E * | 3/2011 | Courtney et al. | 405/186 |
| 8,696,398 | B2 * | 4/2014 | Steger | 441/106 |
| 8,808,048 | B2 * | 8/2014 | Kent | 441/119 |
| 2005/0101203 | A1 | 5/2005 | Kemp | |
| 2011/0004968 | A1 | 1/2011 | Morgan | |
| 2011/0009020 | A1 | 1/2011 | Withers et al. | |
| 2013/0212764 | A1 * | 8/2013 | Kent | 2/2.5 |
| 2014/0057511 | A1 * | 2/2014 | Steger | 441/106 |

FOREIGN PATENT DOCUMENTS

| | | |
|---|---|---|
| WO | WO 99/19206 | 4/1999 |
| WO | WO 2004/056223 | 7/2004 |
| WO | WO 2006/054972 | 5/2006 |

* cited by examiner

PERSONAL PROTECTION SYSTEM INCLUDING A GARMENT WITH BODY ARMOUR AND A PERSONAL FLOTATION DEVICE

RELATED APPLICATIONS

This application claims the benefit of Australian provisional patent application 2012904819 filed 1 Nov. 2012 and Australian complete patent application 2013203831 filed 11 Apr. 2013, which are incorporated by reference herein.

FIELD OF THE INVENTION

This invention relates generally in one aspect to garments of a kind that provide dual protection for a wearer. i.e., both body armour and a personal flotation device (PFD). The invention is of particular application to combat situations where personnel are at risk from both projectile injury and potential drowning. The invention has particular benefit in providing an ability for the wearer to rapidly adapt the equipment to changing circumstances. Different aspects of the invention co-operate to provide a versatile personal protection system.

BACKGROUND OF THE INVENTION

Military personnel involved in waterborne operations are commonly provided with both body armour and a personal flotation device (PFD). Body armour is typically provided in a two part garment that is fastened both at the shoulders and about the waist. The armour may be plate armour and/or more modern soft armour based on super-strong fabrics, and is usually retained in pockets located to give protection to at least the torso, both back and front. PFDs will usually have an inbuilt compressed gas cylinder with an automatic water sensing valve or a hand-releasable valve.

One obvious problem with these conventional arrangements is that, in a combat situation, the PFD may suffer puncture damage, rendering it useless for its primary purpose just when it may most be needed. To address this problem, integrated structures have been proposed. For example, international patent publication WO 2006/054972 discloses an inflatable personal flotation bladder device that lies protected behind the strategic plate of a body armour vest when in its deflated and compressed state, from which an inbuilt compressed gas cylinder can expand the PFD on command. US patent application 2011/0004968 proposes a quite different approach, i.e. a multi-part body armour suit with inboard flotation foam. U.S. Pat. No. 6,659,689 discloses an inbuilt pair of inflatable items: a first ring around the abdominal region which is quick releasable for discardal, and an overlapping removable ring that inflates around the neck to encapsulate the crico-thyroid cartilage, protecting it from compression.

Integrated structures in which a flotation bladder is protected beneath an antiballistic armour layer are also disclosed in European patent application 1587382 and U.S. Pat. No. 7,080,411. The latter discloses a line of studs or hook and loop fastening that breaks apart when the bladder is inflated.

There have also been disclosures, e.g. in U.S. Pat. Nos. 7,182,662 and 3,475,774, of integrated garment structures, not armoured, in which a bladder inflates and expands out of the garment to provide PFD protection. US patent application 2011/0009020 discloses an inflatable bladder or flotation collar that can be inserted, attached or removed from a garment.

Integrated structures address the problem of protecting the uninflated bladder from puncture damage, but such structures may lessen the utility of the garment and its flexibility in different situations. For example, while it may be convenient to have a PFD with a protected inbuilt inflatable bladder, this can be the source of unnecessary discomfort when not required, and once inflated may be a serious encumbrance to motion. After deployment, the wearer may variously wish to retain the PFD and discard the armoured garment, or remain protected by armour and discard the PFD.

It is an object of the invention to provide improved configurations of armoured garment and personal flotation device that allow ready deployment of the PFD yet have inbuilt adaptability to a variety of field situations.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

The essential concept of the invention is to provide a garment and a PFD as separable components that preferably inter-engage in such a way as to provide antiballistic protection for both the wearer and the PFD, while allowing both ready deployment of the PFD and ready separation.

In a first aspect, the invention provides a garment comprising:

a panel adapted to comprise or retain body armour that protects a front region of the torso when the garment is worn;

respective laterally spaced side pockets that extend generally vertically at the front side regions of the torso when the garment is worn, which side pockets have openings at their upper ends to removably receive the respective arms of a generally U-shaped, deflated but inflatable personal flotation device (PFD), that thereby extends behind the neck and/or head of the wearer, which side pockets have outer side fastenings that are separable by the inflating PFD arms to thereby allow the arms to fully expand.

Preferably, when received within the side pockets, the arms of the PFD lie behind and therefore protected by respective portions of the body armour.

In a second aspect, the invention provides an inflatable personal flotation device (PFD), comprising:

a casing defining a central portion and a pair of laterally spaced, generally aligned arms extending therefrom whereby to define a generally U shaped configuration; and bladder means within the central portion and laterally spaced arms, able to receive and retain compressed gas for inflating the personal flotation device;

wherein at least the central portion of the casing is at least partially inlaid or overlaid by armour to protect the bladder means from puncture by impinging projectiles.

In a third aspect, the invention provides a personal protection system comprising a garment according to the first aspect of the invention and an inflatable personal flotation device (PFD) according to the second aspect, the arrangement of the side pockets of the garment and the armour of the inflatable PFD being such that, when the PFD arms, deflated and unexpanded, are received within the side pockets of the garment, the bladder means of the PFD is largely and preferably wholly protected on at least one face by the combined armour of the garment and the PFD.

In an embodiment, the garment may be the front garment of a multi-part body amour vest.

The casing preferably comprises fastenings separable by the inflating bladder means, thereby allowing the bladder means to fully expand. Advantageously, these separable fastenings of the casing and of the PFD are generally aligned with the separable outer side fastenings of the side pockets of the garment.

The separable fastenings are preferably zip fasteners.

The inflatable PFD and the garment are preferably fitted with quick release couplings for securing the two together. In a convenient arrangement, these couplings comprise cooperating eyes or loops linked by a cord or the like arranged to be withdrawn by manual action, for example by a pull device at an end of the cord. There are preferably couplings of this kind at each side of the torso when the garment and PFD are being worn, and in the region of the neck or shoulders.

The garment may be a front shield only, or may be part of a plural component vest to be worn on the torso with both front and back protection.

As used herein, except where the context requires otherwise, the term "comprise" and variations of the term, such as "comprising", "comprises" and "comprised", are not intended to exclude further additives, components, integers or steps.

BRIEF DESCRIPTION OF THE DRAWINGS

The invention will now be further described, by way of example only, with reference to the accompanying drawings, in which.

DESCRIPTION OF PREFERRED EMBODIMENTS OF THE INVENTION

Figure 1:
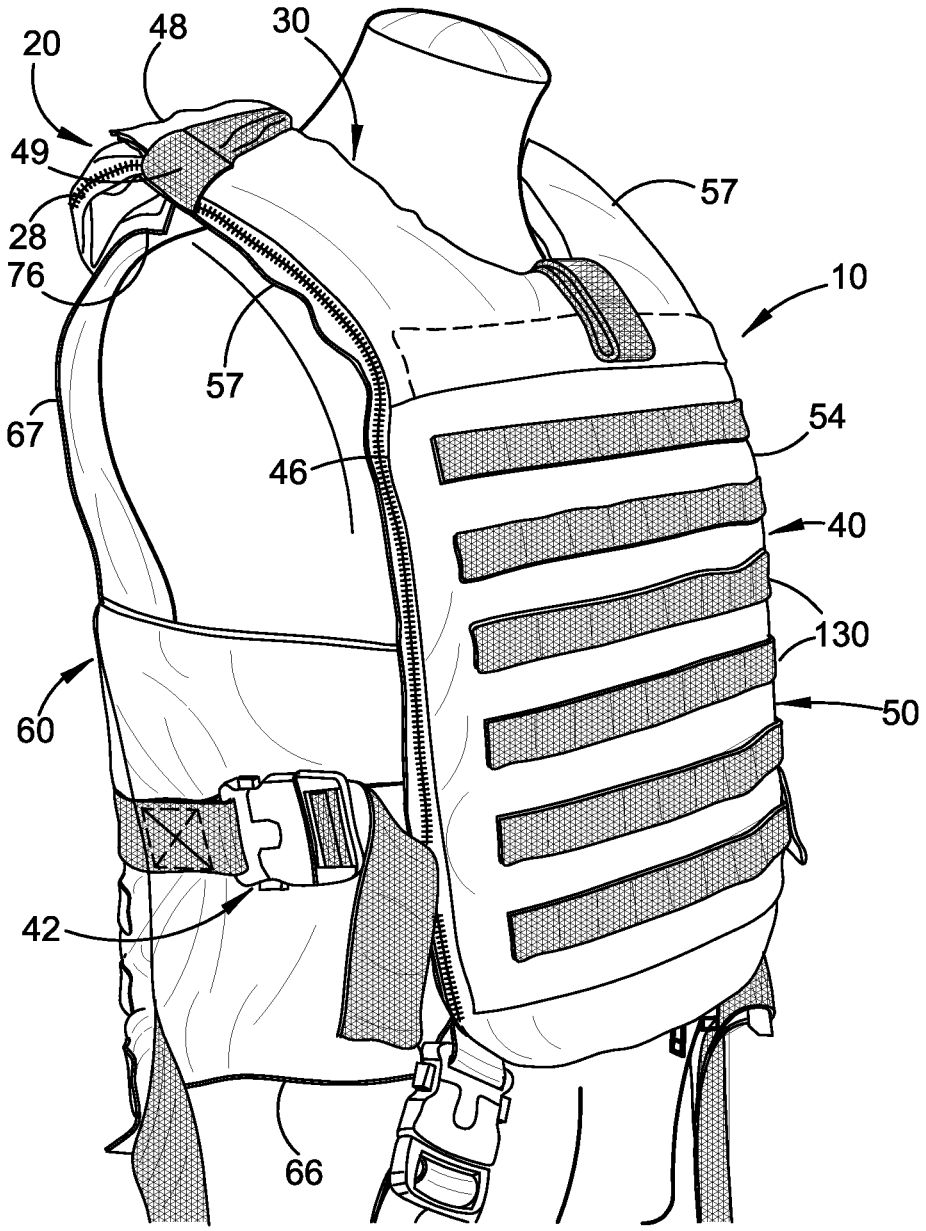
FIGS. 1 and 2 are front and rear perspective views of a personal protection system according to an embodiment of the invention, assembled on a mannequin and shown prior to deployment of the PFD.
Figure 2:
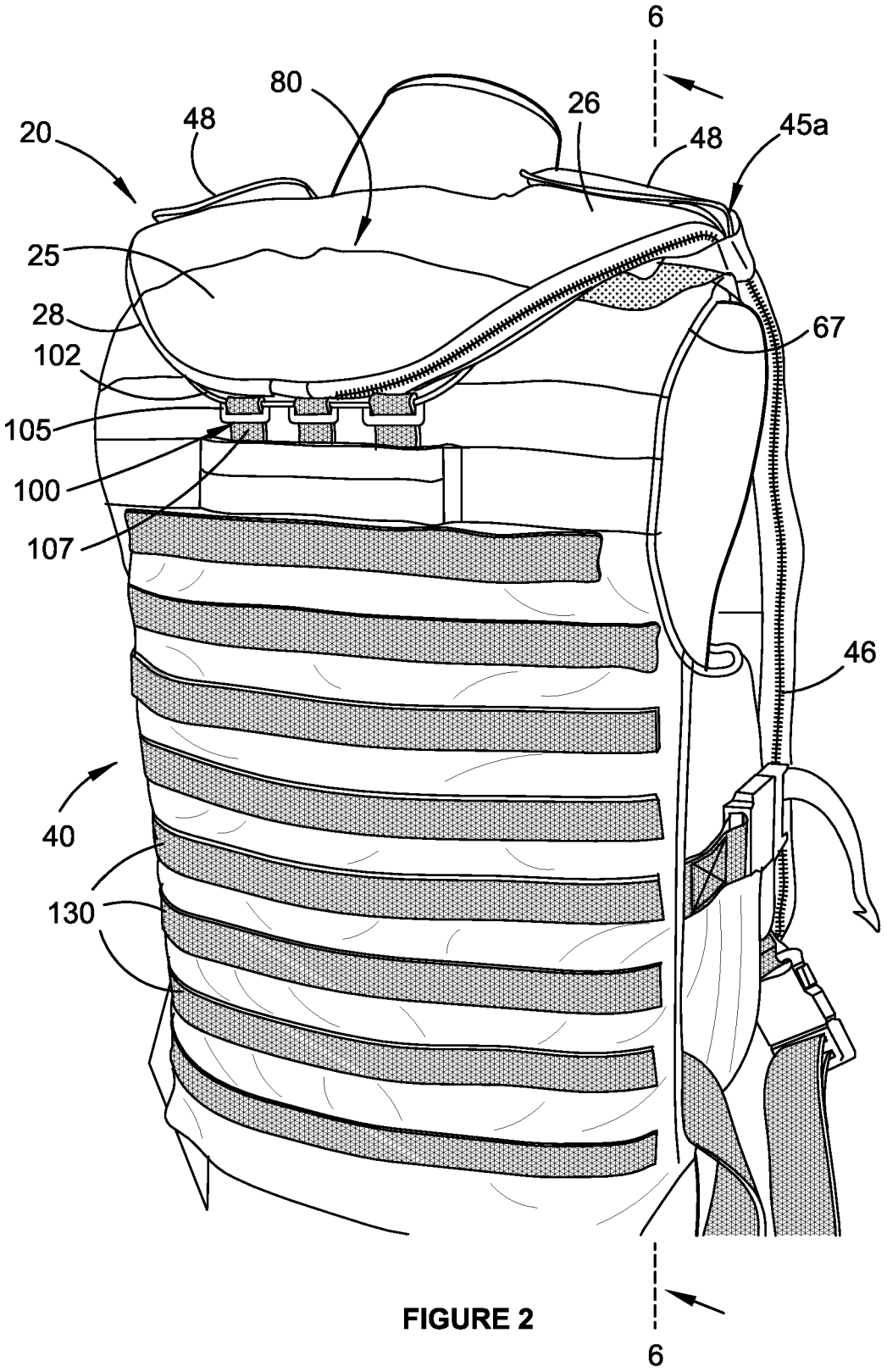
Figure 3:
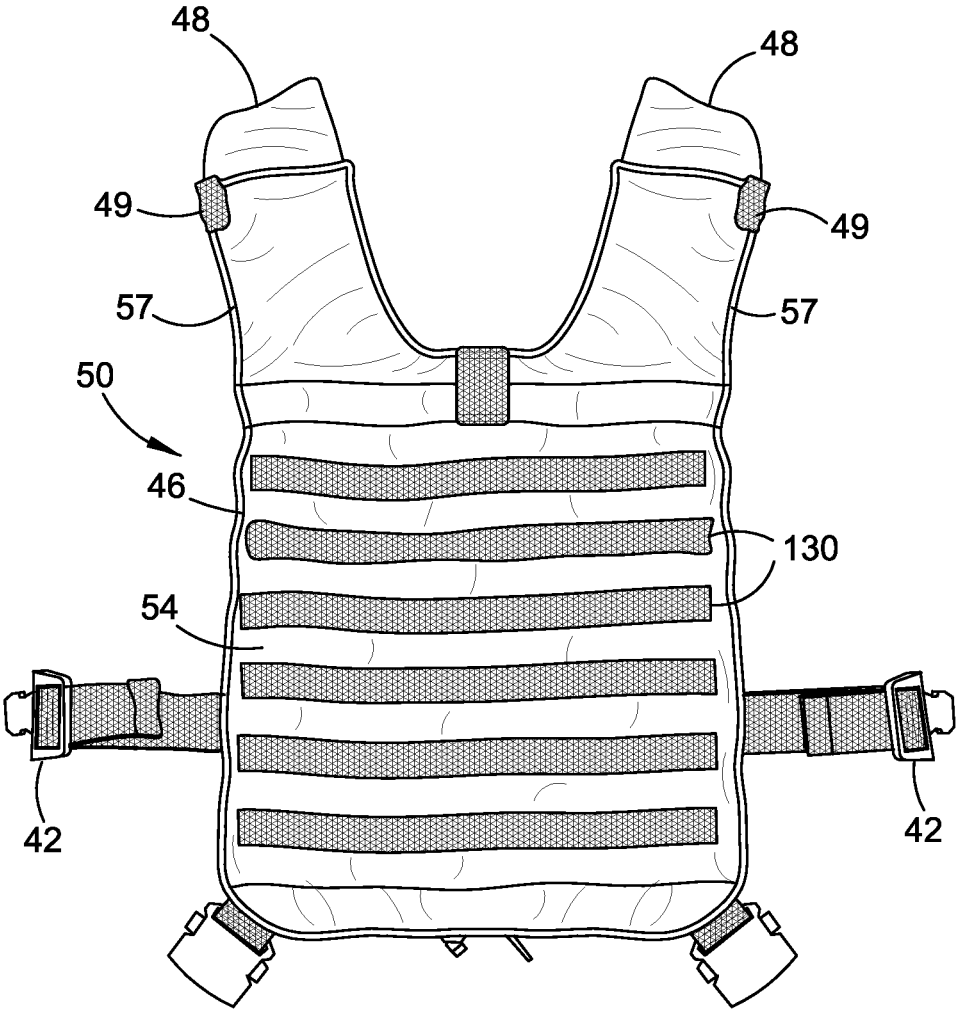
FIG. 3 is a front view of the front garment of the armour vest forming a component of the personal protection system of FIGS. 1 and 2.
Figure 4:
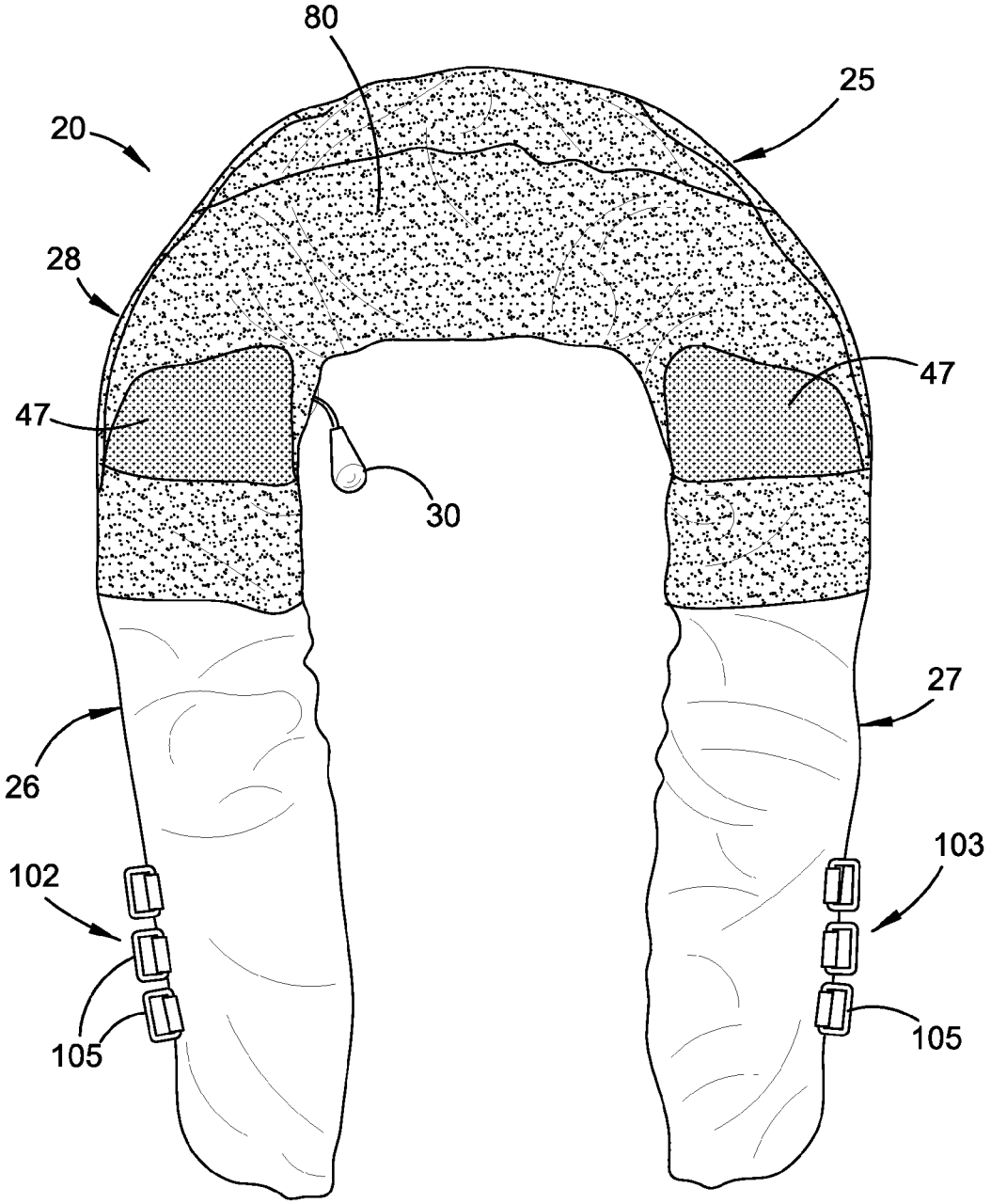
FIG. 4 is a front view of the personal flotation device.
Figure 5:
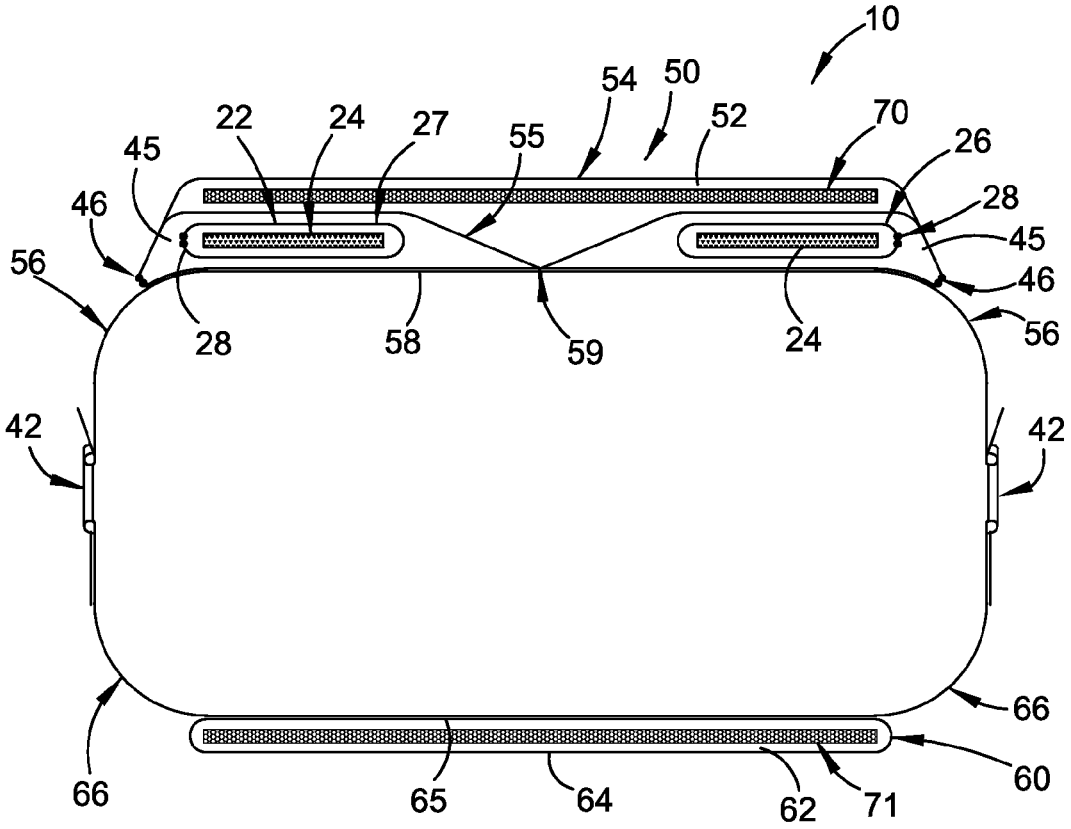
FIG. 5 is a highly schematic cross-sectional drawing of the assembly of FIG. 1 at mid-chest height.
Figure 6:
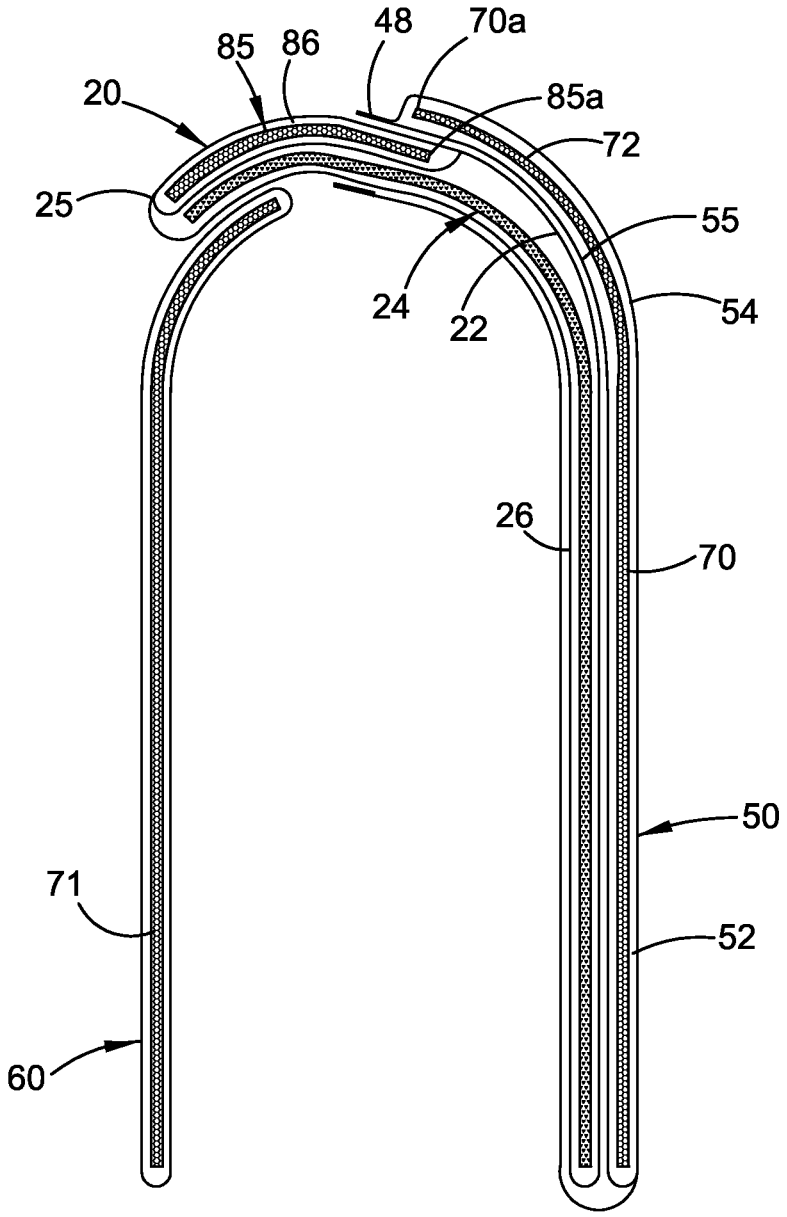
FIG. 6 is a vertical cross section on line 6-6 of FIG. 2.
Figure 7:
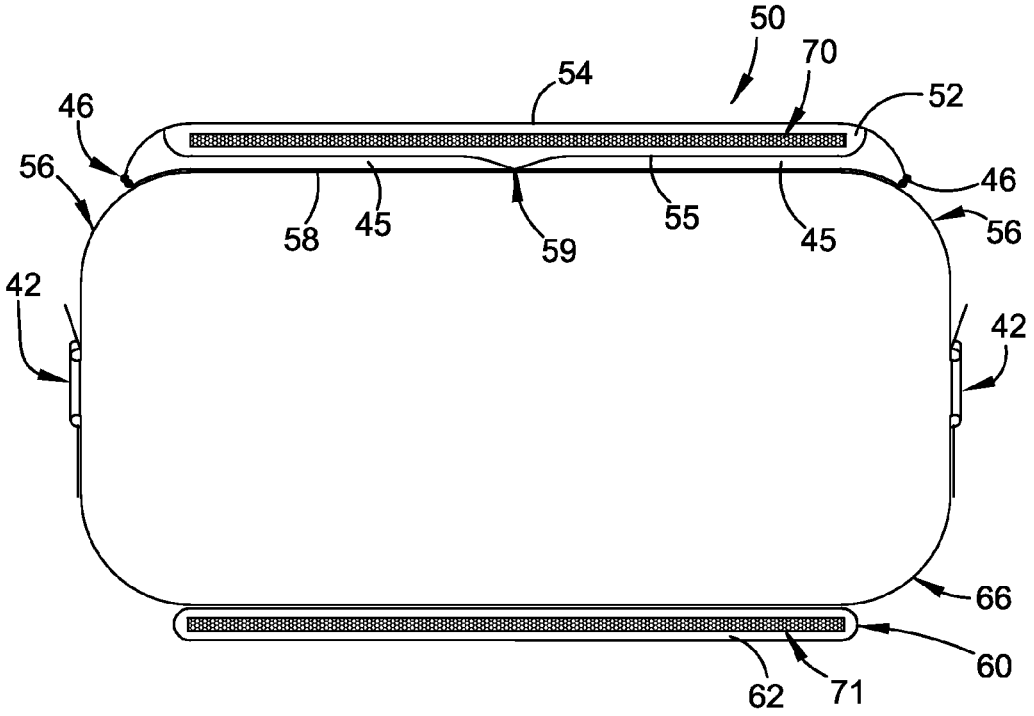
FIGS. 7 and 8 are views corresponding to FIGS. 2 and 3 of the garment only, after the PFD has been withdrawn from the side pockets of the garment.
Figure 8:
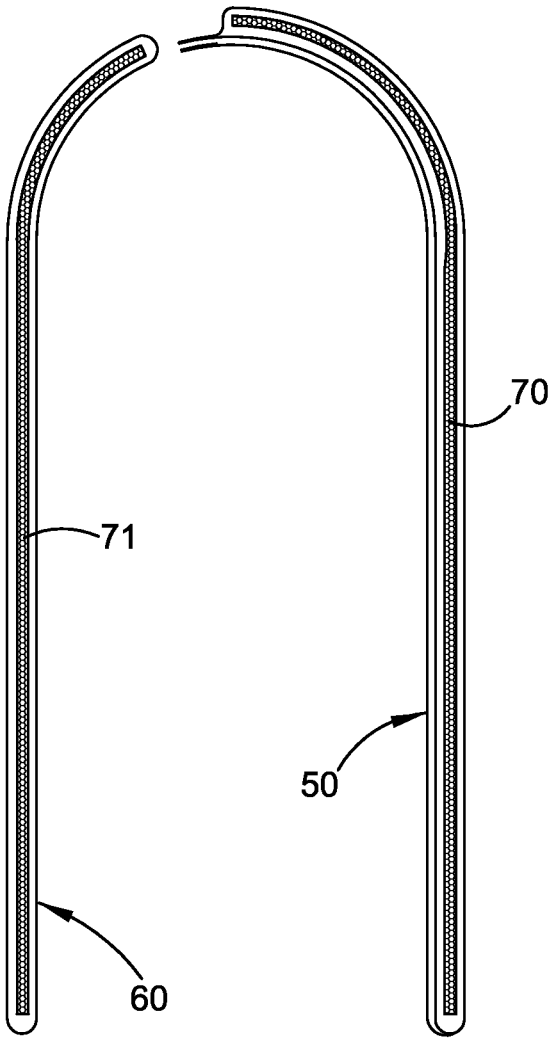

FIGS. 1 to 6 illustrate personal protection system 10 comprising a personal flotation device 20 and a two-part body armour vest 40. The system is depicted in FIGS. 1 to 2 and 3 to 4 in its assembled state while worn on the wearer's body but prior to any deployment of the PFD. As will be discussed, the two principal components comprising the PFD 20 and the armour vest 40 are readily separable and re-assembleable as the circumstances require, both before and after deployment of the PFD.

Vest 40 is in many respects quite conventional, comprising a front garment 50 (shown separately in FIG. 3) and a rear garment 60, each with discrete hard and/or flexible anti-ballistic plates or panels of anti-ballistic soft armour 70, 71, retained within pockets 52, 62, defined by outer 54, 64 and inner 55, 65 fabric panels of the garment. In the waist area at the lower end of the garments, co-operable side bands or straps 56, 66 carry complementary portions of respective buckles 42, for fastening the two garments together about the waist. At the shoulders, upstanding respective shoulder bands 57, 67, may be secured together with respective Velcro (hook and loop) fastenings. The outer surfaces of garments 50, 60 have multiple cross-bands 130 each defining hook-on locations for pockets and equipment comprising weapons and ammunition carriers.

In the case of front vest garment 50 there is a third innermost fabric panel 58 that is contiguous with side bands 56 and is stitched centrally to panel 55 along a vertical line 59 (FIG. 5), or pair of lines, so as to define respective side pockets 45, that extend generally vertically at the front side regions of the torso when the garment is worn. These side pockets 45 are closed at their lower ends by seaming of panels 54, 55 to panel 58, but defined at their outer side edges by respective zip fastenings 46. At their top ends, pockets 45 are open but these openings 45*a* (FIG. 2) may be closed over by flaps 48. Flaps 48 may be removably secured by means of Velcro (hook and loop) fastenings or snap fastenings. As will be seen, when these flaps 48 are disengaged, side pockets 45 are dimensioned to receive the arms of U-shaped PFD 20.

Turning then to the PFD (shown separately in FIG. 4), this comprises an outer flexible casing 22 that, in the deflated collapsed form of the PFD, encloses a bladder 24. The casing has a central or yoke portion 25 and a pair of arms 26, 27 extending there-from to define a generally U-shaped configuration. Casing 22 has, extending around its outermost periphery, zip fasteners 28. Bladder 24 is of a conventional expandable welded plastic coated material and is fitted at the back of central or yoke portion 25 with a small compressed gas cylinder with a valve (not visible) that is releasable by a finger pull cord 30 (beside the neck in situ, selectively on either side) to rapidly inflate the bladder. In an alternative embodiment, the valve is automatically released when a water sensitive switch is triggered after coming into contact with water.

In its deflated, compressed state, PFD 20 is a generally flat and flexible U-shaped object. It is assembled to garment 50 of vest 40 by disengaging the flaps 48 and inserting the arms 26, 27 down into the front side pockets 45 of the garment. When they are fully home, flaps 48 are removably secured. They may, for example be pressed onto an appropriate respective hook and loop pad 47 (FIG. 4) on the outer face of the PFD to provide a seamless, smooth appearance. Alternatively, flaps 48 may incorporate at least one snap fastening and be pressed onto at least one appropriate corresponding snap fastening 47 on the PFD.

As seen in FIG. 1, once the PFD 20 is assembled to garment 50 and the assembly donned, the central or yoke portion 25 of the PFD lies about the wearer's shoulders, behind the neck and lower head. The outer most exposed face 80 of the PFD when so assembled is provided with anti-ballistic soft armour 85. This can be a U-shaped flat piece of armour 85 (FIG. 6), retained within a pocket 86 of the PFD casing 22, or it may be integral with the fabric of casing. The arrangement is desirably such that the front-or lower-most edges 85*a* of armour piece 85 overlap and underlie the uppermost edges 70*a* of front armour 70 (FIG. 6), which itself is formed with two upwardly projecting tapered shoulder portions 72 within shoulder bands 57.

Figure 9:
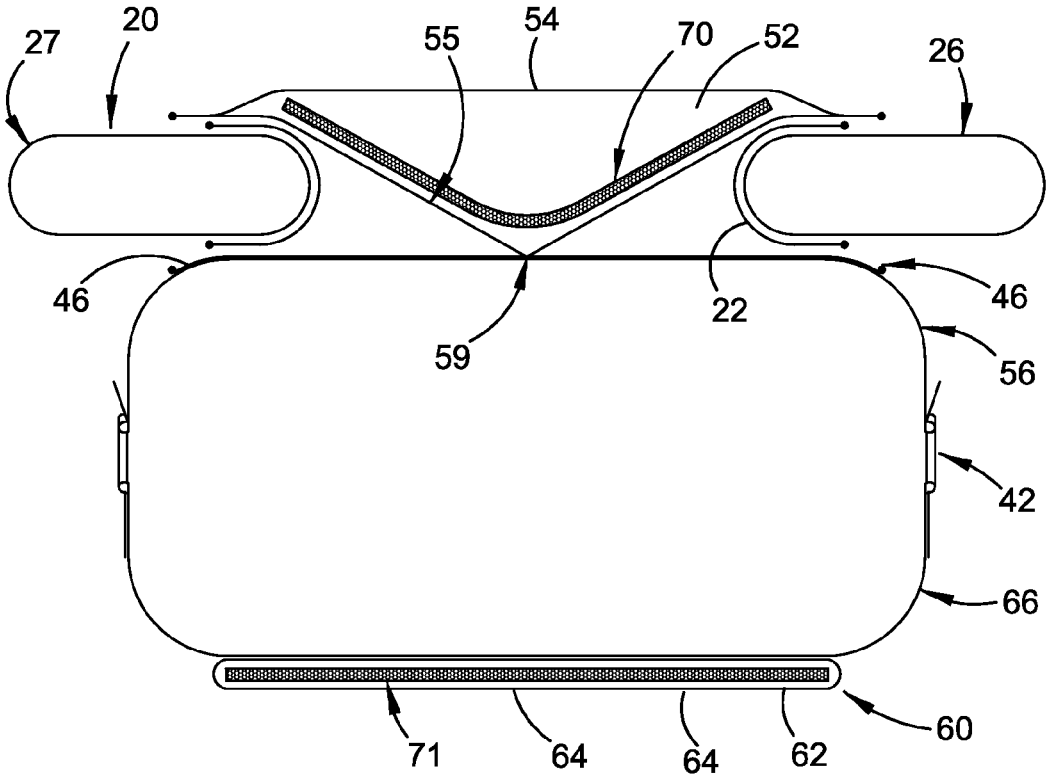
FIG. 9 is a schematic view corresponding to FIG. 2 after the PFD has been fully inflated.
Figure 10:
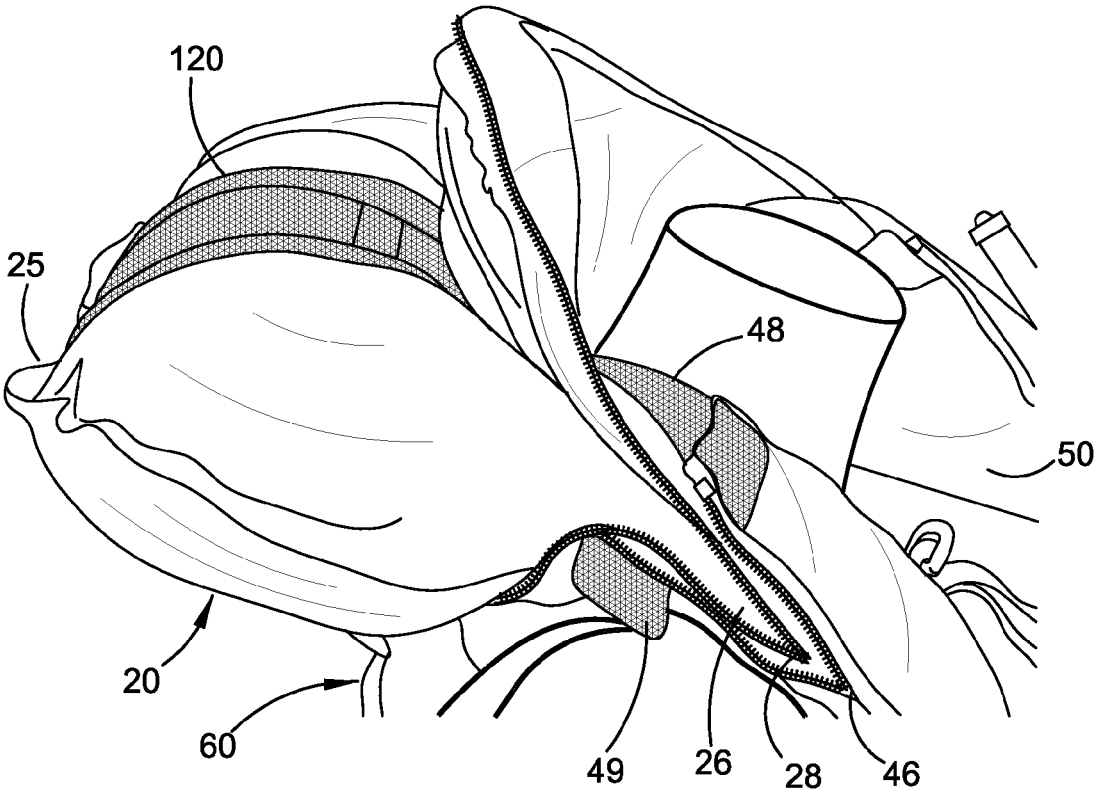
FIG. 10 is a view of the partially inflated PFD in situ.
Figure 11:
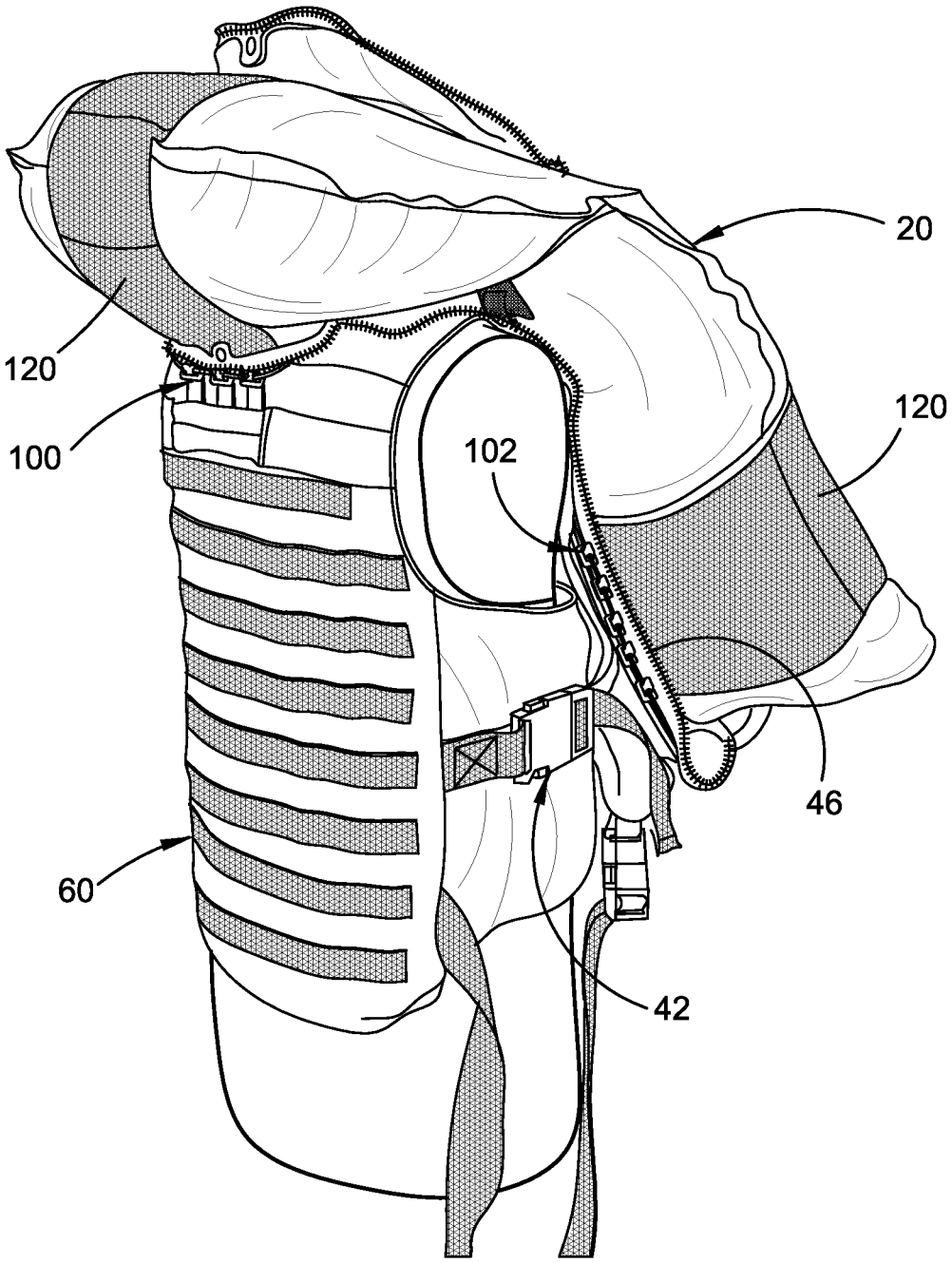
FIG. 11 corresponds to FIG. 2 but with the PFD fully inflated.

Zip fasteners 28, 46 are configured and arranged so that they may be linearly burst open in turn by bladder 24 when the wearer pulls the finger cord 30 to release the valve on the compressed gas cylinder or when the valve is automatically released by a water sensitive switch. Preferably the bladder is configured so that the central or yoke portion 25, expands first (FIG. 10), followed by the side arms. Linear bursting of zip fastener 46 may be facilitated by having the clasp element at the shoulder end not positively engaged with the zip line, but instead overlayed by a Velcro tab 49 which will part under a prescribed pressure to allow the linear bursting of the zip fastener to commence. The outcome of inflation is depicted schematically in FIG. 9, and by drawing in FIG. 11. The seam line or lines 59 at the centre ensure that the force of the expanding bladder is laterally outwards to burst the respective zip fasteners. Front armour 70 may be at least to some degree flexible or bendable to accommodate the expansion of pockets 45 from the centre outwards. FIG. 11 also illustrates two of the three wide bands 120 attached to the PFD casing 22 about the bladder, that serve to attach the bladder to the rear vest garment 60 at releasable couplings 100. These bands 120 are behind the neck and at each side of the wearer's torso.

In other embodiments, the compressed gas cylinder may be substituted with any suitable vessel or means for providing gas to inflate the bladder 24.

When inflation is complete, the wearer has a fully provided PFD correctly in position. By having the central or yoke portion 25 of the PFD already in position before inflation, its correct location, after expansion is assured. The PFD may be protected by a mix of its own armour 85 and the armour 70 of the vest garment in which it is installed.

Figure 12:
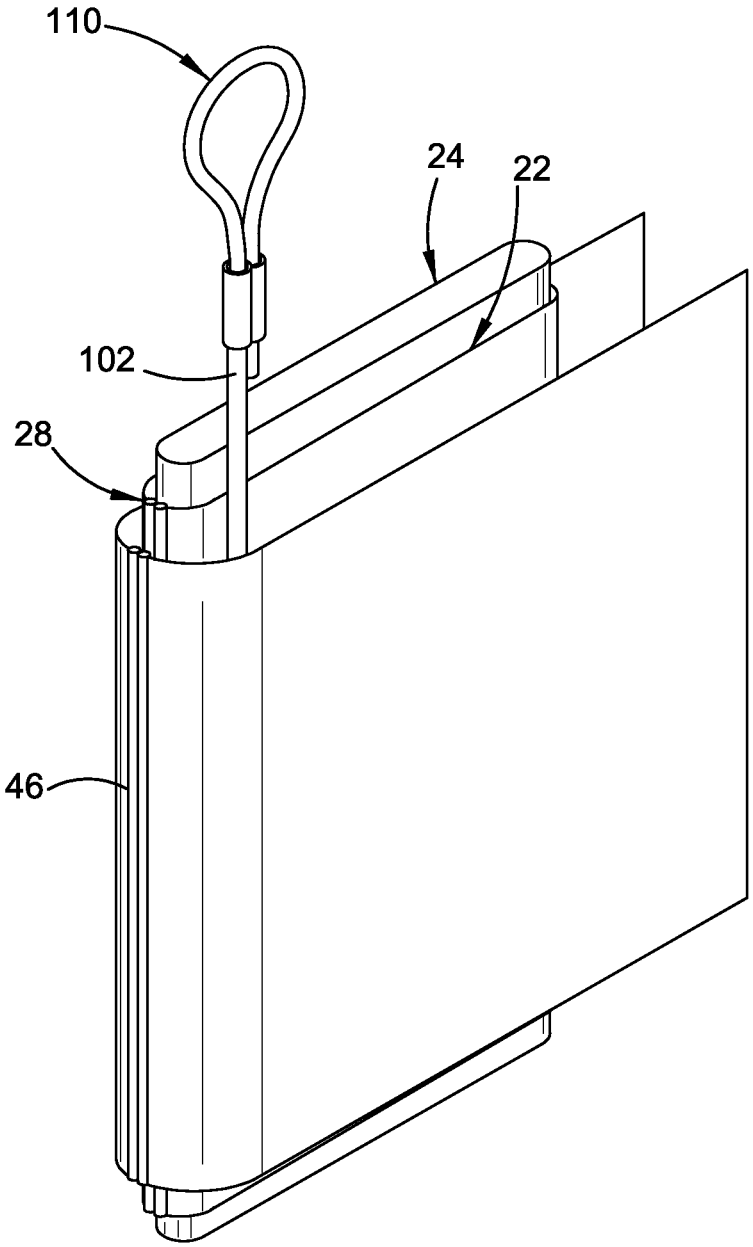
FIGS. 12 and 13 show an exemplary one of the three quick release couplings by which the garment and PFD are secured together as an assembly.
Figure 13:
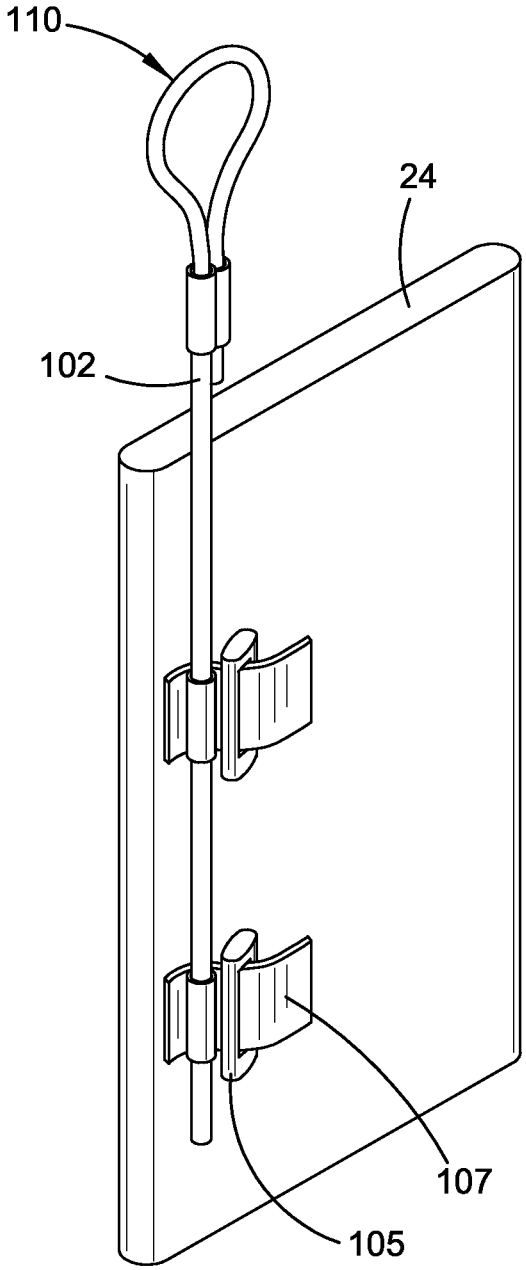

The manner in which the two components of the personal protection system 10 are held together for easy separation will now be outlined with particular reference to FIGS. 12 and 13.

Releasable couplings 100, 102, 103 (FIGS. 2 and 4) are provided behind the neck (to the rear vest garment 60), and along either side of the central seam(s) 59. In many embodiments central seam 59 may in fact be two separate laterally spaced seams. Each coupling comprises (FIG. 2) respective cooperating loops or eyes 105, 107 on the respective components, joined at each coupling by a quick release pull cord 102. The pull cords are led through spaced eyes in the vest to a common location. They terminate in end loops 110 that can be grasped by fingers and pulled sharply to overcome an optional light attachment at their remote ends, whereby the cords pull through the inter-engaged loops to release the coupling 100, 101, 102 of the PFD at the respective locations of the vest. In this way, the PFD is easily released by the wearer either before or after deployment. Such release may be critical after deployment when the wearer may wish to either dump his PFD in order to swim to safety, detach but retain the PFD, discarding the vest in order to swim to safety, or the wearer may have reached safety out of the water and not wish to be encumbered by the inflated PFD.

Figure 14:
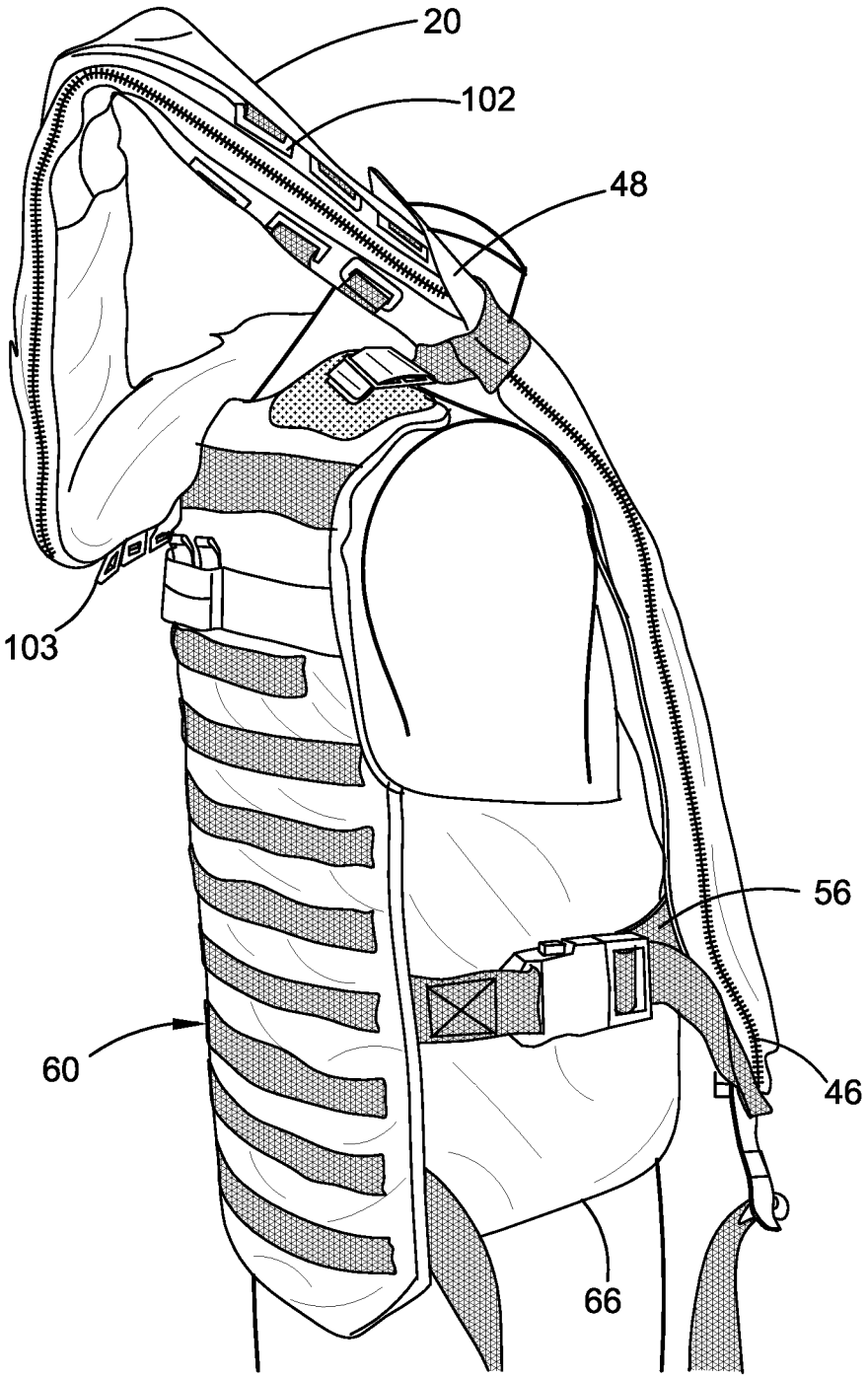
FIG. 14 illustrates removal of the uninflated PFD from the vest.

FIG. 14 illustrates the uninflated, compressed PFD (i.e. before deployment) being withdrawn from side pockets 45 after release of couplings 100, 102, 103.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A garment comprising:

a panel adapted to comprise or retain body armour that protects a front region of the torso when the garment is worn; and respective laterally spaced side pockets that extend generally vertically at the front side regions of the torso when the garment is worn, which side pockets have openings at their upper ends adapted to removably receive the respective arms of a generally U-shaped, deflated but inflatable personal flotation device (PFD), the openings positioned so that the PFD thereby extends outwardly from the openings behind the neck and/or head of the wearer, which side pockets have outer side fastenings that are separable by the inflating PFD arms to thereby allow the arms to fully expand.

2. A garment according to claim 1, wherein when received within the side pockets, the arms of the PFD lie behind and are therefore protected by respective portions of the body armour.

3. A garment according to claim 1, wherein the garment is the front garment of a multi-part body amour vest.

4. A garment according to claim 1, wherein the outer side fastenings are configured to be linearly separable by having at least one end of each side of the outer side fastenings separated.

5. A garment according to claim 4, wherein each separated end of the outer side fastenings is overlaid by a detachably secured flap that is detachable under a prescribed pressure to allow the linear separation of the fastenings to commence.

6. A garment according to claim 1, wherein the separable outer side fastenings are zip fastenings.

7. A garment according to claim 1, wherein the body armour is anti-ballistic soft armour or anti-ballistic plate armour.

8. A garment according to claim 5, wherein the flap is secured by a hook and loop fastening or snap fastening.

9. A garment according to claim 1, further comprising co-operable quick release couplings for securing the inflatable PFD and the garment together, wherein the couplings are located at each side of the torso when the garment and PFD are being worn, and in the region of the neck or shoulders.

10. A garment according to claim 9, wherein the quick release couplings comprise cooperating eyes or and loops linked by a cord or tape arranged to be withdrawn by manual action.

11. A personal protection system comprising:

a garment comprising:

a panel adapted to comprise or retain body armour that protects a front region of the torso when the garment is worn; and respective laterally spaced side pockets that extend generally vertically at the front side regions of the torso when the garment is worn, which side pockets have openings at their upper ends adapted to removably receive the respective arms of a generally U-shaped, deflated but inflatable personal flotation device (PFD), the openings positioned so that the PFD thereby extends outwardly from the openings behind the neck and/or head of the wearer, which side pockets have outer side fastenings that are separable by the inflating PFD arms to thereby allow the arms to fully expand; and an inflatable personal flotation device (PFD) comprising:

a casing defining a central portion and a pair of laterally spaced, generally aligned arms extending therefrom whereby to define a generally U shaped configuration; and bladder means within the central portion and the laterally spaced arms, able to receive and retain compressed air for inflating the bladder means and the personal flotation device, wherein at least the central portion of the casing is at least partially inlaid or overlaid by armour to protect the bladder means from puncture by impinging projectiles;

wherein the arrangement of the side pockets of the garment and the armour of the inflatable PFD being such that, when the PFD arms, deflated and unexpanded, are received within the side pockets of the garment, at least one face of the bladder means of the PFD is largely protected by the combined armour of the garment and the PFD.

12. A personal protection system according to claim 11, wherein the casing comprises fastenings separable by the inflating bladder means, thereby allowing the bladder means and the PFD to fully expand, and the separable fastenings of the casing are generally aligned with the separable outer side fastenings of the side pockets of the garment.

13. A personal protection system according to claim 12, wherein the outer side fastenings are configured to be linearly separable by having at least one end of each side of the outer side fastenings separated.

14. A personal protection system according to claim 13, wherein each separated end of the outer side fastenings is overlaid by a detachably secured flap that is detachable under a prescribed pressure to allow the linear separation of the fastenings to commence.

15. A personal protection system according to claim 11, wherein the inflatable PFD and the garment are fitted with co-operable quick release couplings for securing the inflatable PFD and the garment together, wherein the couplings are located at each side of the torso when the garment and PFD are being worn, and in the region of the neck or shoulders.

16. A personal protection system according to claim 15, wherein the quick release couplings comprise cooperating eyes or and loops linked by a cord or tape arranged to be withdrawn by manual action.

17. A personal protection system according to claim 11, wherein the bladder means is configured so that the central portion expands first, followed by the laterally spaced arms.

18. A personal protection system according to claim 11, further including a compressed air vessel co-operable with the bladder means.

19. A personal protection system according to claim 11, wherein the inflatable PFD is a self-contained inflatable PFD.

20. A personal protection system according to claim 19, wherein at least the central portion of the casing of the inflatable PFD is at least partially inlaid or overlaid by armour integral with or secured to the casing.

* * * * *